US009615187B2

(12) United States Patent
Gatien et al.

(10) Patent No.: US 9,615,187 B2
(45) Date of Patent: Apr. 4, 2017

(54) AUDIO SIGNAL VERIFICATION FOR VIDEO/AUDIO PRODUCTION EQUIPMENT

(71) Applicant: ROSS VIDEO LIMITED, Iroquois, Ontario (CA)

(72) Inventors: Benoit Gatien, Navan (CA); Troy David English, Ottawa (CA)

(73) Assignee: Ross Video Limited, Ontario (CA)

( * ) Notice: Subject to any disclaimer, the term of this patent is extended or adjusted under 35 U.S.C. 154(b) by 94 days.

(21) Appl. No.: 14/574,428

(22) Filed: Dec. 18, 2014

(65) Prior Publication Data

US 2016/0183020 A1 Jun. 23, 2016

(51) Int. Cl.
*H04R 29/00* (2006.01)

(52) U.S. Cl.
CPC ..... *H04R 29/00* (2013.01)

(58) Field of Classification Search
CPC ..... H04R 29/00
See application file for complete search history.

(56) References Cited

U.S. PATENT DOCUMENTS

2002/0191107 A1* 12/2002 Hu ..... H04N 5/04 348/515
2003/0142232 A1* 7/2003 Albean ..... G11B 27/10 348/512
2013/0194496 A1* 8/2013 Atherton ..... H04N 21/4307 348/515
2014/0307107 A1* 10/2014 Yang ..... H04N 5/04 348/194
2014/0355774 A1* 12/2014 Quan ..... H04R 29/00 381/58

* cited by examiner

*Primary Examiner* — Regina N Holder
(74) *Attorney, Agent, or Firm* — Nixon Peabody LLP; Jeffrey L. Costellia

(57) ABSTRACT

Audio signal verification methods and apparatus for video/audio production equipment are disclosed. An audio signal and a video signal are input into production equipment. The audio signal has one or more known frequencies, and the video signal has a known video frame to which the audio signal is to be synchronized by the equipment. Based on the known frequency or frequencies and a frequency or frequencies of an output audio signal that is output by the equipment with the video frame, a determination can be made as to whether the output audio signal corresponds to the input audio signal. Respective values could be assigned to a number of frequencies, to enable values to be encoded in the input audio signal. The correspondence determination could then be made based on whether the values encoded by frequencies in the output audio signal match the values encoded in the input audio signal.

17 Claims, 5 Drawing Sheets

AUDIO SIGNAL VERIFICATION FOR VIDEO/AUDIO PRODUCTION EQUIPMENT

FIELD

The present disclosure relates generally to video/audio production, and more specifically to verification of audio signals. This could include verifying whether a correct audio signal is present and whether that audio signal is synchronized with a video signal.

BACKGROUND

Current methods of verifying an audio signal, and determining synchronization between audio and video signals, are manual and time consuming. Multiple signals including multiple audio sources are used and detecting whether the correct audio source is being synchronized with video can be difficult. Furthermore, the audio/video signals may be out of synchronization by a very small amount (milliseconds) which would be hard to detect with these current methods.

There are a number of methods in the art to detect whether audio and video are out of synchronization, but these do not determine whether the source of the audio is accurate or whether the audio signal contains defects. Still other methods in the art describe generating both an audio and video test signal in order to test for synchronization, which adds additional complexity to the testing process. These methods are specific to synchronization of the audio and video signals.

Still other methods require complex processes whereby an audio signal is analyzed, processed, and resynchronized with a video signal, or whereby the synchronization is tested by using various fields including time clock and program clock reference fields. Again, these methods relate specifically to synchronization of the signals.

SUMMARY

According to an aspect of the present disclosure, a method involves: inputting an audio signal into video/audio production equipment, the audio signal having a known frequency; inputting a video signal into the video/audio production equipment, the video signal having a known video frame to which the audio signal is to be synchronized by the video/audio production equipment; and determining, based on the known frequency and a frequency of an output audio signal that is output by the video/audio production equipment with the video frame, whether the output audio signal corresponds to the audio signal.

The audio signal could include a series of known signal components with respective different known frequencies. One of the signal components has the known frequency referenced above. In this case, the determining involves determining whether the output audio signal corresponds to the audio signal based on the known frequencies and frequencies of the output audio signal.

In an embodiment, the determining involves: determining whether frequencies of the output audio signal match the known frequencies; and determining that the output audio signal does not correspond to the audio signal where any one or more of the known frequencies does not have a matching frequency in the output audio signal.

The method could also involve repeating the inputting and determining for multiple audio signals and multiple video frames.

Another embodiment involves adding delay to one of the audio signal and the video signal responsive to determining that the output audio signal does not correspond to the audio signal.

The method could also include: calculating an amount by which the output audio signal is out of synchronization with the known video frame where it is determined that the output audio signal does not correspond to the audio signal; and adding, to one of the audio signal and the video signal, delay based on the amount by which the output audio signal is out of synchronization with the known video frame.

The respective different known frequencies could encode a message from a predetermined sequence of messages respectively associated with different audio signals to be synchronized to different video frames of the video signal by the video/audio production equipment. The determining could then involve determining whether the frequencies of the output audio signal encode a message matching a message encoded by the known frequencies. The method could include, responsive to determining that the frequencies of the output audio signal do not encode a message matching a message encoded by the known frequencies: calculating an amount by which the output audio signal is out of synchronization with the known video frame based on relative positions, in the predetermined sequence of messages, of the message encoded by the frequencies of the output audio signal and the message encoded by the known frequencies; and adding, to one of the audio signal and the video signal, delay based on the amount by which the output audio signal is out of synchronization with the known video frame.

The audio signal could include transitions at known positions between the known signal components, in which case the method could also include: determining transition positions between signal components of the output audio signal that have respective different frequencies; calculating an amount by which the output audio signal is out of synchronization with the known video frame based on transition positions of the output audio signal and the known positions; and adding, to one of the audio signal and the video signal, delay based on the amount by which the output audio signal is out of synchronization with the known video frame.

An apparatus according to another aspect of the present disclosure includes: a frequency detector to receive an output audio signal that is output by video/audio production equipment with a video frame, and to determine a frequency of the output audio signal; and a comparator, coupled to the frequency detector, to determine based on the frequency of the output audio signal and a known frequency, whether the output audio signal corresponds to an audio signal that has the known frequency and was input into video/audio production equipment to be synchronized with the video frame by the video/audio production equipment.

The frequency detector and the comparator could be implemented using a computing device to execute software stored in a non-transitory computer-readable medium.

In an embodiment, the audio signal includes a series of known signal components with respective different known frequencies, and one of the known signal components has the known frequency referenced above. The frequency detector could then be configured to determine frequencies of the output audio signal, and the comparator could be configured to determine whether the output audio signal corresponds to the audio signal based on the known frequencies and the frequencies of the output audio signal.

The comparator could be configured to determine whether frequencies of the output audio signal match the known frequencies, and to determine that the output audio signal does not correspond to the audio signal where any one or more of the known frequencies does not have a matching frequency in the output audio signal.

The frequency detector could be configured to receive multiple output audio signals that are output with respective video frames, and to determine frequencies of each of the multiple audio signals, and the comparator could then be configured to determine whether each output audio signal corresponds to one of a plurality of audio signals that were input into the video/audio production equipment to be synchronized with the respective video frames by the video/audio production equipment.

In an embodiment, the apparatus also includes a controller, operatively coupled to the comparator.

The controller could provide a control signal to cause the video/audio production equipment to add delay to one of the audio signal and the video signal responsive to a determination by the comparator that the output audio signal does not correspond to the audio signal.

The controller could also determine an amount by which the output audio signal is out of synchronization with the known video frame, and provide the control signal to cause the video/audio production equipment to add, to one of the audio signal and the video signal, delay based on the amount by which the output audio signal is out of synchronization with the known video frame.

The respective different known frequencies could encode a message from a predetermined sequence of messages respectively associated with different audio signals to be synchronized to different video frames of the video signal by the video/audio production equipment, in which case the comparator could be configured to determine whether the output audio signal corresponds to the audio signal by determining whether the frequencies of the output audio signal encode a message matching a message encoded by the known frequencies. A controller could be operatively coupled to the comparator: to determine an amount by which the output audio signal is out of synchronization with the known video frame based on relative positions, in the predetermined sequence of messages, of the message encoded by the frequencies of the output audio signal and the message encoded by the known frequencies, responsive to a determination by the comparator that the frequencies of the output audio signal do not encode a message matching a message encoded by the known frequencies; and to provide a control signal to cause the video/audio production equipment to add, to one of the audio signal and the video signal, delay based on the amount by which the output audio signal is out of synchronization with the known video frame.

The audio signal could include transitions at known positions between the known signal components. A controller could be operatively coupled to the comparator, to determine an amount by which the output audio signal is out of synchronization with the known video frame based on transition positions between the frequencies of the output audio signal and the known positions, and to provide a control signal to cause the video/audio production equipment to add, to one of the audio signal and the video signal, delay based on the amount by which the output audio signal is out of synchronization with the known video frame.

Another aspect of the present disclosure relates to a method that involves: assigning respective values to a plurality frequencies; inputting, into video/audio production equipment, an audio signal having multiple known frequencies of the plurality of frequencies encoding in the audio signal multiple known values of the respective values; determining frequencies in an output audio signal that is output by the video/audio production equipment; decoding values of the respective values encoded by the determined frequencies in the output audio signal; and determining, based on whether the values encoded by the determined frequencies in the output audio signal match the known values encoded in the audio signal, whether the output audio signal corresponds to the audio signal.

The respective values could be hexadecimal values or base-32 values.

Other aspects and features of embodiments of the present disclosure may become apparent to those ordinarily skilled in the art upon review of the following description.

BRIEF DESCRIPTION OF THE DRAWINGS

Examples of embodiments of the invention will now be described in greater detail with reference to the accompanying drawings.

DETAILED DESCRIPTION

Figure 1:
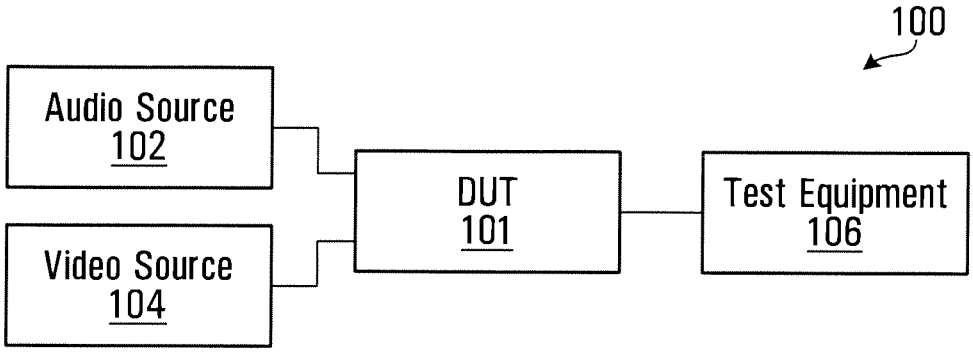
FIG. 1 is a block diagram of an example audio signal verification system.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the scope of an invention as defined by the appended claims.

As discussed in detail herein, embodiments may provide such features as verifying an audio signal source, detecting irregularities and determining whether audio and video signals are in synchronization, and generating a delay to correct synchronization error. Example embodiments will now be described with reference to the figures provided.

FIG. 1 is a block diagram of an example audio signal verification system. The example system 100 includes a device under test (DUT) 101, an audio source 102, a video source 104, and test equipment 106, coupled together as shown. The example system shown in AG. 1, as well as the embodiments shown in the other drawings, are intended solely for illustrative purposes. A system, for example, could include similar or different components interconnected in a similar or different manner than shown in FIG. 1.

The type(s) of connection(s) through which the components shown in FIG. 1 are coupled together is implementation-dependent. Any of various types of connectors and cables could be used to couple the audio source 102 and the video source 104 to the DUT 101. In an embodiment, the audio source 102 and the video source 104 are coupled to the DUT 101 in the same way that an audio source and a video source would be coupled to the DUT 101 when it is in service. The DUT 101 could already be in service during audio signal verification, in which case the audio source 102 and the video source 104 are used to feed input channels of the DUT 101. The coupling between the DUT 101 and the test equipment 106 could be a direct cabled connection or a network connection, for example.

The DUT 101 is a device to be tested, and could include any video/audio production equipment, such as various types of professional video production equipment. Examples of such equipment include devices that handle High Definition (HD), Ultra High Definition (UHD), National Television System Committee (NTSC), and/or Phase Altering Line (PAL) video signals. Video signals in these formats could be carried over Serial Digital Interface (SDI) links, HDMI (High Definition Multimedia Interface) cables, or component video cables, for example.

The audio source 102 could be implemented, for example, using hardware, firmware, components which execute software, or some combination thereof. Electronic devices that might be suitable for this purpose include, among others, microprocessors, microcontrollers, Programmable Logic Devices (PLDs), FPGAs, Application Specific Integrated Circuits (ASICs), and other types of "intelligent" integrated circuits. In one embodiment, the audio source 102 is a computer which uses a stored .wav the to generate an audio signal containing one or more known frequencies.

The audio signal that is generated or otherwise provided to the DUT 101 by the audio source 102 could be an analog signal or a digital representation of an analog signal. In one embodiment, the audio signal from the audio source 102 is an encoded signal in which information is encoded by changing the frequency three times per video frame such that there are three different frequencies for each frame of video. For example, the first frequency could be used to identify the audio source 102 or a channel onto which the audio signal from the audio source is input, and the next two frequencies could be used to identify a corresponding frame of video in a video signal from the video signal source 104. However, it should be understood that the number of frequency changes per frame can vary in other embodiments, and that information encoding is an optional feature.

Any of various types of video sources could be used to implement the video source 104. In one embodiment, the video source 104 includes a video server or other device that stores video. A video camera could be used to capture video for the purposes of supplying a video signal to the DUT 101 for audio signal verification. More generally, like the audio source 102, the video source 104 could be implemented, for example, using hardware, firmware, components which execute software, or some combination thereof.

Figure 6:
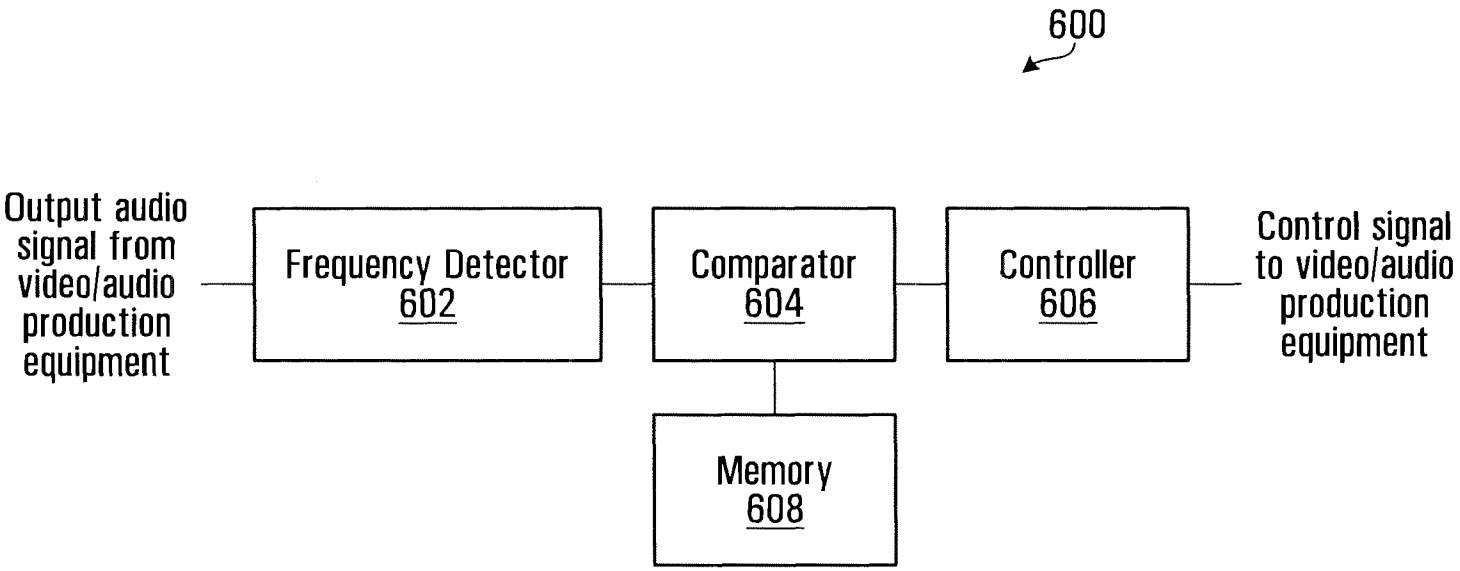
FIG. 6 is a block diagram of an example apparatus.

The test equipment 106 could similarly be implemented using hardware, firmware, components which execute software, or some combination thereof. An example of test equipment is shown in FIG. 6 and described below.

In operation, the audio source 102 supplies an audio signal as an input to the DUT 101, the video source 104 supplies a video signal as another input to the DUT, and the output of the DUT is analyzed by the test equipment 106. The analysis by the test equipment 106 could involve any of various analysis methods, examples of which are disclosed herein.

Figure 2:
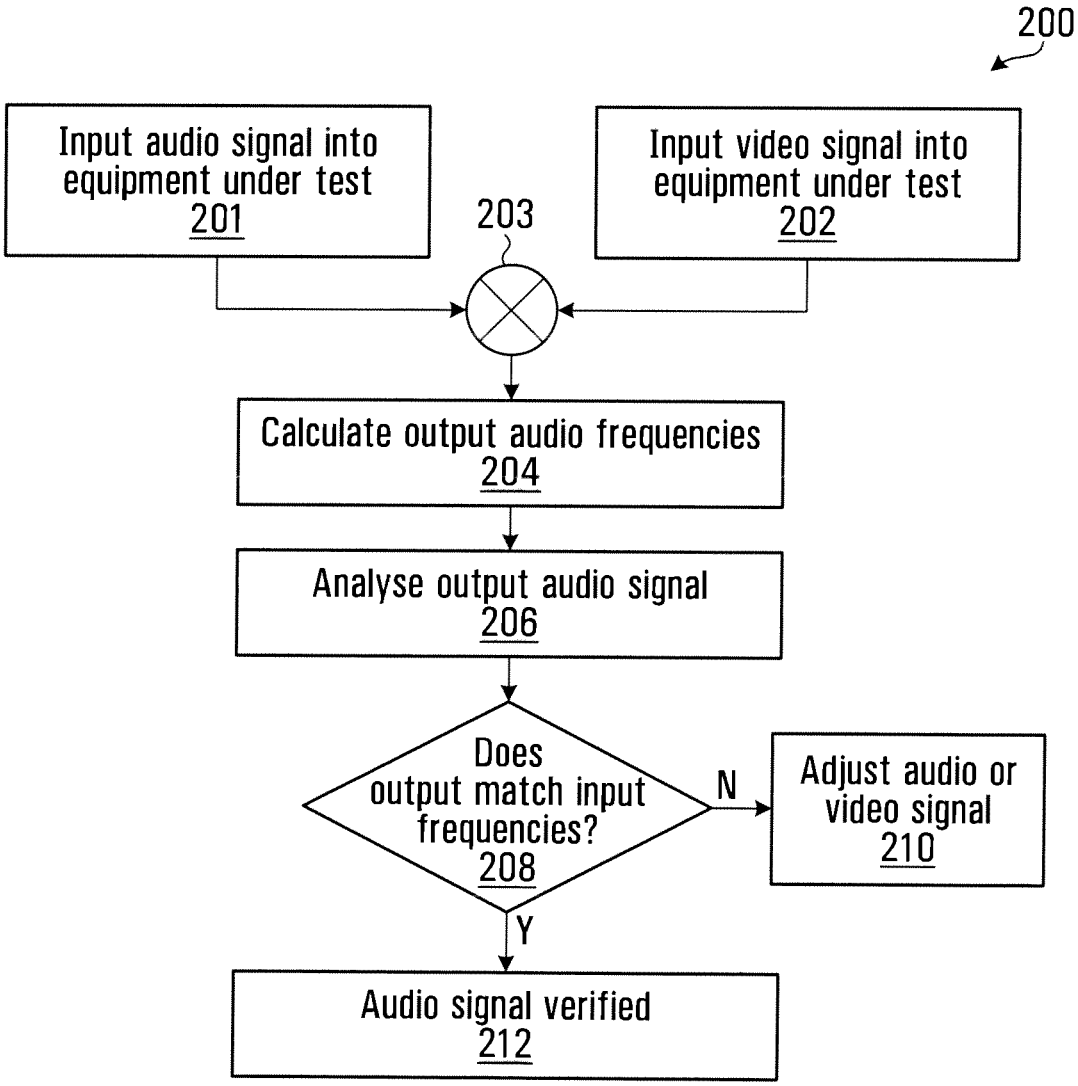
FIG. 2 is a flow chart of an example method.

FIG. 2 is a flow chart of an example method. In the example method 200, an audio signal and a video signal are input into video/audio production equipment (e.g., the DUT 101 in FIG. 1), at 201, 202. The audio signal is to be synchronized to the video signal by the video/audio production equipment. This is represented in FIG. 2 at 203. The output audio frequencies in an output of the DUT are calculated at 204, and further analysis may be performed at 206. At 208, a determination is made as to whether the calculated output audio frequencies match known audio frequencies in the audio signal that was input at 201. Frequency comparison is illustrative of further analysis that may be performed at 206. If the frequencies match, then the audio signal is verified at 212 to be accurate and in synchronization. If the output audio signal frequencies do not match the known set of frequencies of the audio input signal, then the audio source may be incorrect or the audio and video signals may be out of synchronization.

In an embodiment, the audio input signal includes three known frequencies, and the first frequency out of the three encodes a value relating to the audio source itself. If the first frequency is not a match, then it is likely that the audio source is incorrect. In this example, if it is either of the second or third frequencies, or both, that are not a match, then the audio and video signals are out of synchronization. The second and third frequencies could encode other values to allow the amount of time that the audio and video signals are out of synchronization to be calculated by analyzing the output audio signal at 206, or more specifically by analyzing the output audio signal frequencies determined at 204.

Different frequencies may be used to represent numbers or letters. For example, a frequency of 1200 Hz=A, 800 Hz=0, 400 Hz=1, 200 Hz=2, etc. The first frequency of 1200 Hz or A, may represent the channel or source of the input audio signal. In an embodiment, each frame of video corresponds to three different frequencies of audio, so frame one of video may contain or otherwise be associated with an audio signal with frequencies 1200 Hz, 800 Hz and 400 Hz. Therefore, if these frequencies are present in an input audio signal on channel A, then the output audio signal should contain frequencies that "translate" to A01. Video frame two could similarly contain 1200 Hz, 800 Hz and 200 Hz audio signal components and would translate to A02, and so on. In this example, the output audio signal from channel A should contain A01, A02, A03, etc. If the output audio signal shows B01, B02 and B03 for the first three video frames, then an audio signal is from a different channel, specifically channel B, is being linked to the video frame. If the output audio signal has frequencies that encode A06, A07, A08, then the audio signal is not in synchronization with the video frame. Any other combinations other than A01, A02, A03 indicates that there is a problem with the audio.

If the analyzed output audio signal does not match to the known input frequencies, but it is clear that it is coming from the correct channel, then the audio signal synchronization could be adjusted at 210 by delaying either the audio signal or the video signal.

Figure 3:
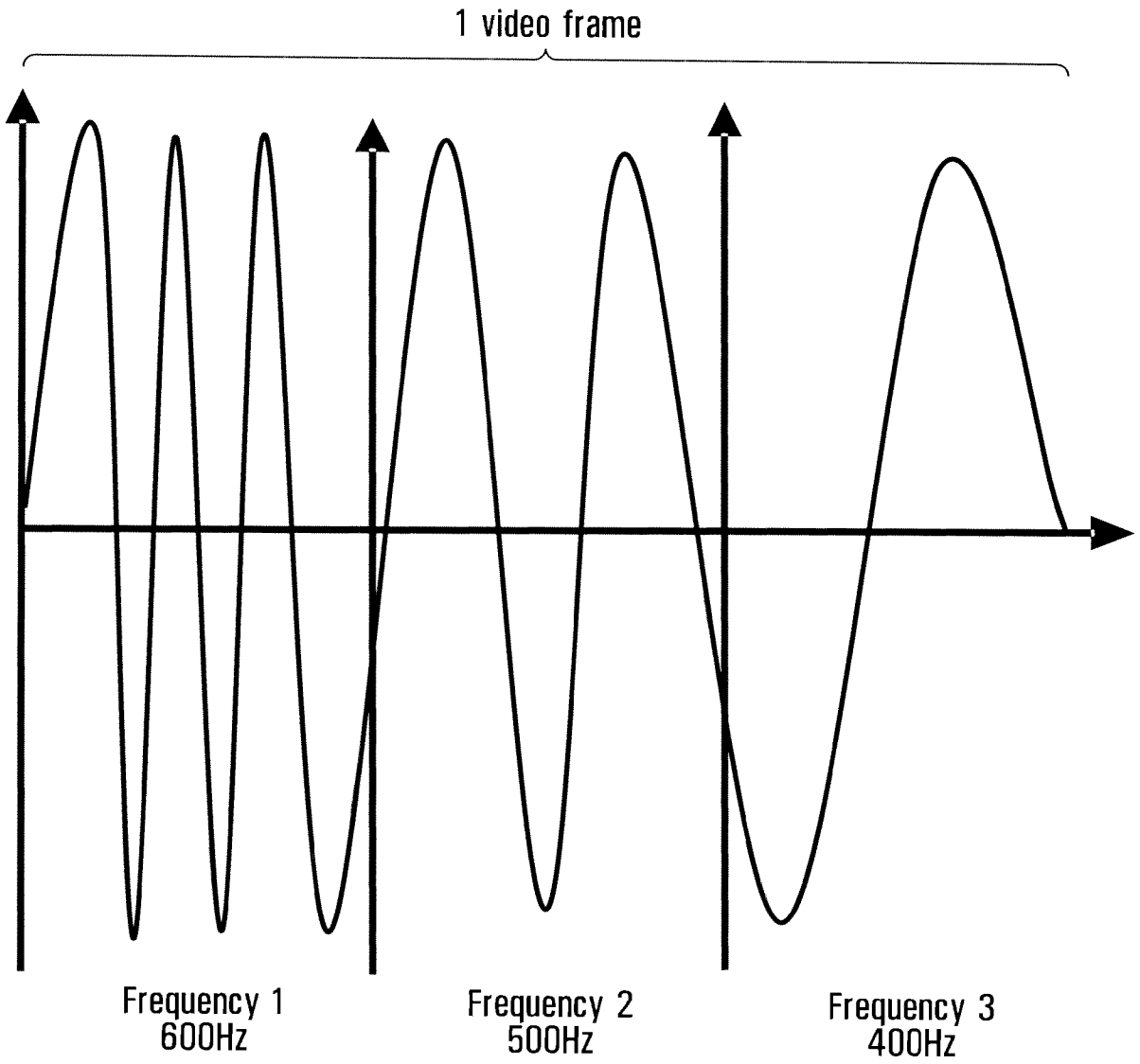
FIG. 3 is a plot of an example audio signal.

FIG. 3 is a plot of an example audio signal, which could be used as an input audio signal at a DUT. There are three distinct audio frequencies for each video frame in the example shown, with the illustrated video frame having a corresponding audio signal with the following three frequencies: 600 Hz, 500 Hz, and 400 Hz. Each frame of video has a different set of audio frequencies in one embodiment, in order to allow the audio signal for one video frame to be distinguished from the audio signal(s) for the previous and/or following frame(s). For example, frame one may have a first frequency of 600 Hz, frame two might have a first frequency of 750 Hz, frame three might have a first frequency of 800 Hz, and so on. FIG. 3 is an example, and the present disclosure is not in any way dependent upon the specific example frequencies or sequence of frequencies shown.

Figure 4:
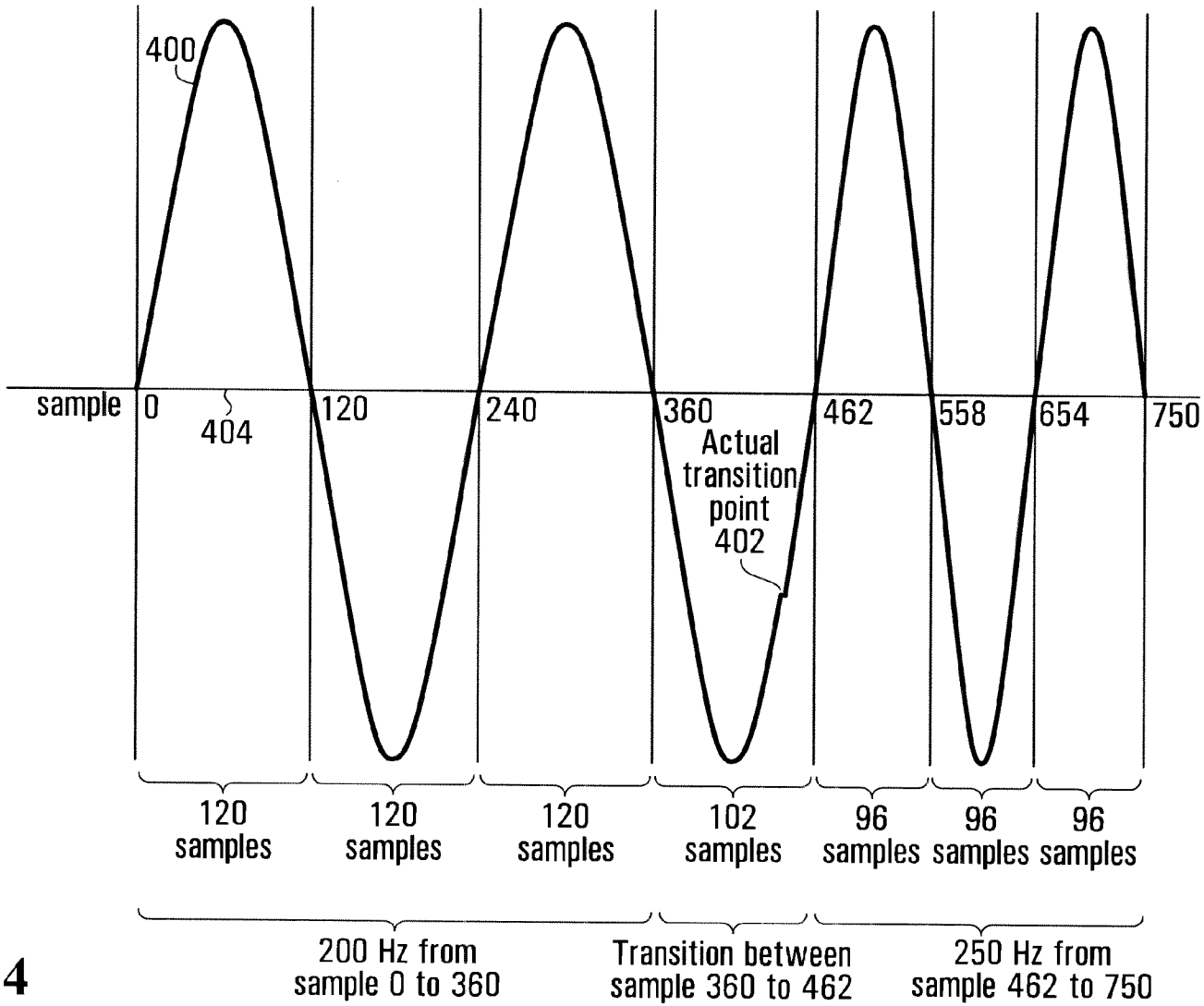
FIG. 4 is a plot of an example output audio signal, and also illustrates an example of a sampling process.

FIG. 4 is a plot of an example output audio signal, and also illustrates an example of a sampling process. In the embodiment shown, samples of the example output audio signal 400 are taken between zero-crossings, where amplitude of the example output audio signal changes between negative and positive. There need not be samples exactly at the zero crossings, as a zero crossing can be inferred when one sample has one polarity (positive or negative) and the next sample has opposite polarity. This would occur at sampling points before and after the example output audio signal crosses zero amplitude, which is designated in FIG. 4 by axis 404. It is amplitude polarity, and not magnitude, that is used in the sampling process shown in FIG. 4.

Two frequencies are represented in FIG. 4, which are unknown frequencies in the case of an output audio signal. The actual transition point between the frequencies is shown at 402.

For illustrative purposes, the following variables are defined:

N=number of audio samples per video frame.

P=number of audio samples of one polarity, between polarity changes (negative to positive or positive to negative).

FPS=video frames per second.

The frequency (F) may then be determined using the following formula:

$$F=(N/(2P))*\text{FPS}.$$

The 2P term in the formula above arises from the fact that P corresponds to the number of samples of one polarity between polarity changes, or in other words the number of samples per half cycle. In order to calculate frequency in a classical sense, the number of samples per full cycle (i.e., 2P) is used. It should be noted, however, that half-cycle frequency could be used as the basis for audio signal verification, as long as half-cycle frequency is used consistently, as both input audio signal frequency and output audio signal frequency.

In the case of a standard NTSC signal which has FPS=30 frames per second and N=1600 samples per frame, if P=120 samples, then the calculation from the above formula is as follows:

$$F=(1600/(2*120))*30=200\text{ Hz},$$

for the first frequency in the example output audio signal 400 in FIG. 4.

For the second unknown frequency, the example output audio signal has FPS=30 frames per second and N=1600 samples per frame, but with P=96. The calculation for F in this case is as follows:

$$F=(1600/(2*96))*30=250\text{ Hz}.$$

When sampling the output audio signal, transition points between different frequencies may result in some unexpected sample results. These anomalous frequency transition samples are detected and discarded so that the results are not skewed. In the example shown in FIG. 4, the actual transition point 402 causes an anomalous one-time sample count of 102 samples, which is different from both the preceding sample count and the subsequent sample count. On this basis, the anomalous sample count could be detected and discarded.

The output audio signal may also be analyzed for missing audio, incorrect audio including pops or hisses, and/or other audio defects, which would disrupt an expected audio signal, illustratively a test sine wave for example. Such defects could be detected based on signal samples as outlined above. If anomalous sample counts are detected and do not correlate to a known transition point between frequencies, then these sample counts are indicative of defects in the output audio signal.

As noted above, the example sampling process illustrated in FIG. 4 uses polarity and not magnitude of samples. Therefore, this sampling process and its related frequency calculation method are unaffected by changes in gain of an audio signal, and could be used for audio signal verification for video/audio equipment that alters the gain of audio signals.

It should be noted that other methods of determining the frequency of an output audio signal are possible and remain within the scope of the present disclosure.

With a known video frame and a sampled and analyzed output audio signal, multiple frames of video and audio signals may be cross-referenced to determine whether audio is from the correct source or channel for each frame and whether it is synchronized. Variations in synchronization may be detected in this way.

Different methods may be used to verify which video frame is being analyzed, including using a Vertical ANCillary space (VANC) time code, counting from a first frame that is not still, counting from a first non-black frame and so on. There are numerous ways of tracking video frames, and the present disclosure is not limited to any particular type of video frame tracking.

Figure 5:
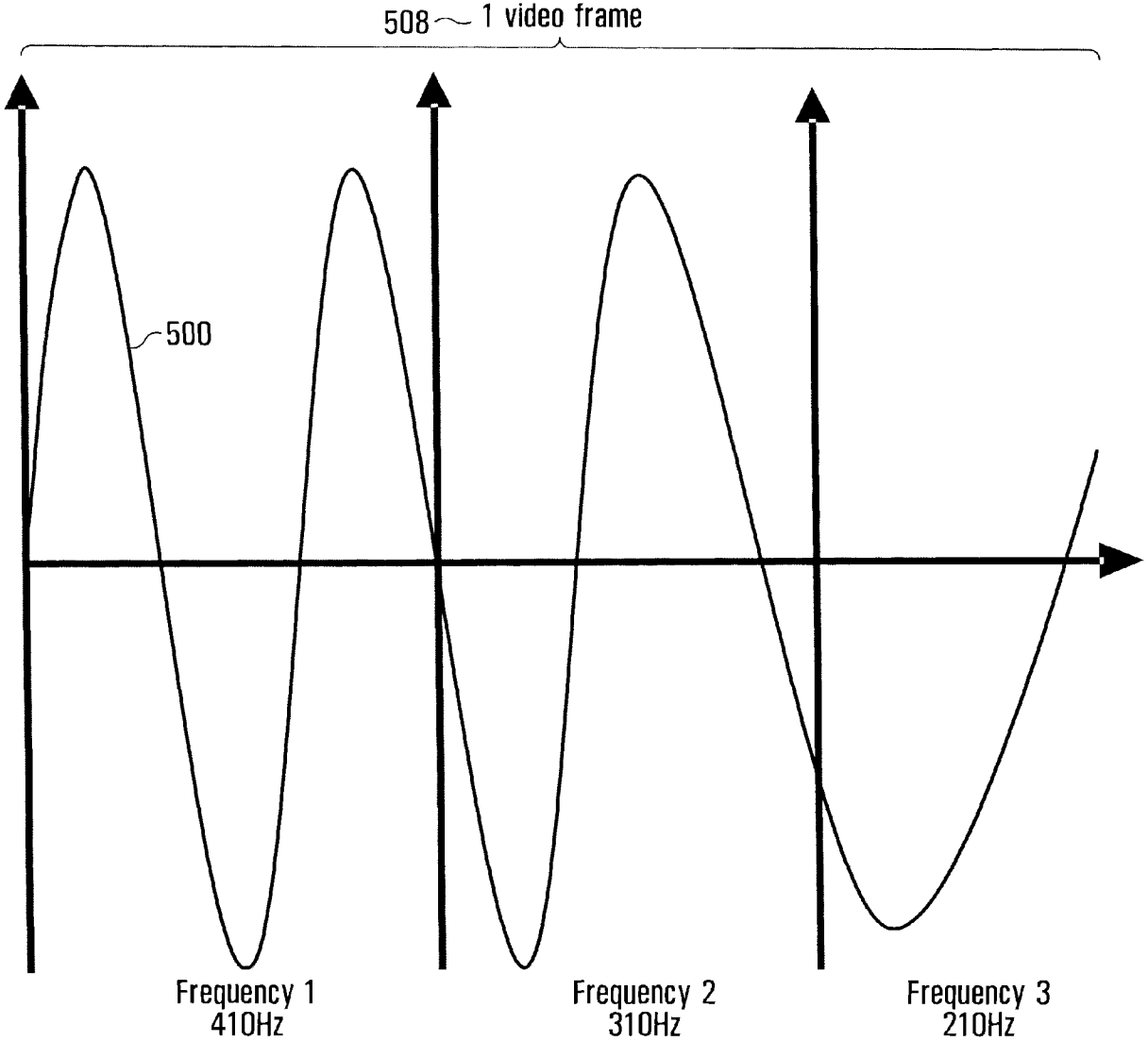
FIG. 5 is a plot of another example output audio signal.

FIG. 5 is a plot of another example output audio signal 500 of a DUT. The first frequency 502 in the video frame 508 is 410 Hz, which is approximately the same frequency as the third frequency of the input audio signal (400 Hz) shown in FIG. 3. In this example the output audio signal is out of synchronization. Continuing the frequency progression illustrated in FIG. 3, a next video frame has an associated audio signal with frequency components at 300 Hz, 200 Hz, and 100 Hz. The second frequency 504 of 310 Hz and the third frequency 506 of 210 Hz then correspond to the next video frame, meaning that the audio is ahead of the video by almost 1 complete video frame.

While example methods described herein may be used to verify an audio signal, including detection of whether it is out of synchronization with a video signal, other embodiments may also be used to automatically correct synchronization between the audio and video signals in a DUT by detecting how much out of synchronization the signals are and compensating for the difference. The signals may be synchronized by adding a delay to either the audio signal or video signal by the amount the signals are out of synchronization. There are a number of ways to synchronize the signals, including various ways of delaying one signal or the other, at DUT inputs or within the DUT for example.

Although any series of audio signal input frequencies may be used in audio signal verification, some frequencies may work better than others. For example, for some frequencies the number of samples per half cycle are whole numbers (e.g., 10 samples instead of 10.5 samples). In general, frequencies which result in a whole number of samples and varying sample counts between zero crossings could be mathematically more convenient to work with.

Audio verification as disclosed herein need not be limited to verifying audio in equipment that is only under testing and is not yet in service. For example, a Serial Data Interface (SDI) signal contains sixteen channels of audio. With standard broadcasting, channels one and two are typically the stereo audio of the broadcast and channels three and four may be used for audio containing a different language. Channels five and six may be a commentary track. It is uncommon for all the channels to be used during a broadcast. Therefore a test audio signal may be placed on an unused channel.

For example, channel sixteen may be deemed to be the channel reserved for testing and a test audio signal is input on that channel. Once the broadcast reaches its destination, the synchronicity of the test audio signal on the reserved channel, or any unused channel(s) chosen for testing, may be determined using the same techniques disclosed herein. If the test audio signal is out of synchronization by a number (x) of frames in relation to the video signal, then it may be assumed that all the audio on the used channels are also out of synchronization by x frames, and those channels may be adjusted accordingly. In this example, audio verification results for one channel are applied to other channels, or in other words characteristics of non-tested channels are inferred from the tested channel(s).

As noted above, data may be encoded inside an audio signal using the known frequencies. This could be extended beyond encoding of audio source and audio information such as A01, A02, etc. described above. For example, base-32 encoding or hexadecimal encoding could be used to encode messages in the known frequencies. By using a pair of frequencies together, an audio signal may be encoded with the expected video frame number. In the case of base-32 encoding, video frames from 0 to 1023 may be identified by encoded audio signals. This would work out to about seventeen seconds of video at 60 frames per second (fps) so the encoding would repeat every seventeen seconds, but would allow the detection of out of synchronization audio up to seventeen seconds apart from the video.

Longer messages could be encoded into an audio stream by using more known frequencies. For example, by encoding eight known frequencies, a time code defined as HH:MM:SS:FF may be represented.

Alternatively, by using a hexadecimal encoding scheme, a particular hexadecimal value can be assigned for each frequency (e.g., 4800 Hz is 0, 3200 Hz is 1, 2400 Hz is 2, . . . 128 Hz is E, 120 Hz is F). A hexadecimal message may be hidden (i.e., encoded) in an audio signal and decoded when the output audio signal is analyzed.

Example methods are described in detail above. More generally, a method could include inputting an audio signal and a video signal into video/audio production equipment, illustratively a DUT 101 as shown in FIG. 1. The audio signal has a known frequency, and the video signal has a known video frame to which the audio signal is to be synchronized by the video/audio production equipment. These inputting operations are illustrated at 201, 202 in FIG. 2. Based on the known frequency and a frequency of an output audio signal that is output by the video/audio production equipment with the video frame, it is determined whether the output audio signal corresponds to the audio signal. Although this type of determination involves multiple input and output frequencies at 204, 206, 208 in FIG. 2, there need not be multiple frequencies in other embodiments.

The correspondence between the output audio signal and the input audio signal could be correspondence in terms of source and/or synchronization. In this example, if the frequency of the output audio signal matches the known frequency, then the output audio signal corresponds to the input audio signal. This could be considered a version of the determination at 208 in FIG. 2 involving a single known frequency and a single output frequency. Frequency matching need not be exact, and frequencies could be considered to match if they are within a certain tolerance of each other. For example, an output frequency of 210 Hz could be considered to match a known frequency of 200 Hz. Frequency matching tolerances could be absolute (e.g., a specific frequency difference) or relative (e.g., a percentage of the known frequency).

The audio signal that is input to the video/audio production equipment could include a series of known signal components with respective different known frequencies, including one signal component having the known frequency referenced above. The determination as to correspondence between the output audio signal and the input audio signal is then based on the known frequencies and frequencies of the output audio signal. At 208 in FIG. 2, this involves determining whether frequencies of the output audio signal match the known frequencies. The output audio signal does not correspond to the audio signal where any one or more of the known frequencies does not have a matching frequency in the output audio signal.

The inputting of audio and video signals and determining correspondence could be repeated for multiple audio signals and multiple video frames. This is not explicitly shown in FIG. 2, but methods disclosed herein are not limited to only one audio signal or only one video frame.

Responsive to determining that the output audio signal does not correspond to the audio signal, delay could be added to one of the audio signal and the video signal. This is illustrative of an adjustment that could be applied at 210 in FIG. 2.

The added delay is based on the amount by which the output audio signal is out of synchronization with the known video frame. This out-of-synchronization amount could be calculated on determining that the output audio signal does not correspond to the audio signal, and could be based on the known frequencies and the output frequencies as discussed herein with reference to FIG. 5, or based on encoded messages.

For example, the respective different known frequencies in a multiple-frequency embodiment could be used to encode a message from a predetermined sequence of messages respectively associated with different audio signals to be synchronized to different video frames of the video signal. This is described above by way of example with reference to frequencies encoding A01, A02, etc. In this case, the determination as to audio signal correspondence involves determining whether the frequencies of the output audio signal encode a message matching a message encoded by the known frequencies in the input audio signal. Responsive to determining that the frequencies of the output audio signal do not encode a message matching a message encoded by the known frequencies, an amount by which the output audio signal is out of synchronization with the known video frame could be calculated based on relative positions, in the predetermined sequence of messages, of the message encoded by the frequencies of the output audio signal and the message encoded by the known frequencies. If the sequence of messages include A01, A02, . . . , the input audio frequencies encode A01, and the output audio frequencies encode A02, then the output audio signal is ahead of its video frame by one frame, and a delay of one frame could be added to the audio signal. In the case of the video frame being ahead of the output audio signal, with A02 being encoded in the input audio signal frequencies but A01 being encoded in the output audio signal frequencies, for instance, a one-frame delay could be applied to the video frame. More generally, delay based on the amount by which the output audio signal is out of synchronization with the known video frame is added to one of the audio signal and the video signal.

Delay calculations could instead be based on transitions at known positions between the known signal components in the audio signal. Transition positions between signal components of the output audio signal that have respective different frequencies could then be determined, and an amount by which the output audio signal is out of synchronization with the known video frame can be calculated based on transition positions of the output audio signal and the known positions. Delay based on the amount by which the output audio signal is out of synchronization with the known video frame can be added to one of the audio signal and the video signal.

Calculations based on transition positions could provide even more granularity in determining delays or out of synchronization amounts. A frame-based calculation could be accurate to a number of frames to determine that an audio/video stream is 3 frames out of synchronization, for example, but a transition-based calculation could be accurate to a sub-frame level, to determine that an out of synchronization amount is actually 3.66 frames for instance.

Some embodiments disclosed herein refer to comparing frequencies in input and output audio signals to determine whether the frequencies match. According to another embodiment, a method involves assigning respective values to a number of frequencies and inputting (at 202 in FIG. 2, for example), into video/audio production equipment such as the DUT 101 in FIG. 1, an audio signal having multiple known frequencies selected from the number of frequencies to which the respective values are assigned. The multiple known frequencies encode in the audio signal multiple known values of the respective assigned values. Frequencies in an output audio signal that is output by the video/audio production equipment are determined, as shown at 204 in FIG. 2, for example. Such a method may also involve decoding values that are encoded by the determined frequencies in the output audio signal. This is illustrative of another example of analysis that could be performed at 206 in FIG. 2. Based on whether the values encoded by the determined frequencies in the output audio signal match the known values encoded in the audio signal, a determination is made as to whether the output audio signal corresponds to the audio signal. The determination of audio signal correspondence in this example could involve matching of encoded values instead of the frequency matching shown at 208 in FIG. 2, although both approaches are equivalent since the frequencies encode the values.

As noted above, values that are assigned and encoded could be hexadecimal values or base-32 values, for example.

Embodiments are described above primarily in the context of example methods. Apparatus embodiments are also contemplated.

FIG. 6 is a block diagram of an example apparatus. The example apparatus 600 includes a frequency detector 602, a comparator 604, a controller 606, and a memory 608, which are coupled together as shown, and represents an illustrative example of test equipment 106 (FIG. 1). As noted above with reference to FIG. 1, the types of interconnections between the components shown in FIG. 6 are implementation-dependent. For example, the example apparatus 600 could be implemented in a computing device, in which case the interconnections could include internal connections of the types typically found in computing devices. The interconnections could also or instead include logical interconnections between components that are implemented using a processor or other element to execute software. In such an implementation, components could be logically interconnected through variables, registers, and/or common memory locations, for example.

Any or all of the frequency detector 602, the comparator 604, and the controller 606 could be implemented using hardware, firmware, one or more components which execute software, or some combination thereof. Examples of electronic devices that might be suitable for this purpose are provided above.

The memory 608 includes one or more memory devices of any of various types. Solid-state memory devices and/or memory devices with movable or even removable storage media could be provided. In an embodiment, the frequency detector 602 and the comparator 604, and possibly the controller 606 as well, are implemented using a computing device to execute software stored in a non-transitory computer-readable medium in the memory 608.

In operation, the frequency detector 602 receives an output audio signal that is output by video/audio production equipment with a video frame, and determines a frequency of the output audio signal. This could involve the sampling process described herein, for example. The comparator 604 determines, based on the frequency of the output audio signal and a known frequency, whether the output audio signal corresponds to an audio signal that has the known frequency and was input into video/audio production equipment to be synchronized with the video frame by the video/audio production equipment.

In an embodiment, the audio signal includes a series of known signal components with respective different known frequencies, and the frequency detector 602 determines frequencies of the output audio signal. The comparator 604 then determines whether the output audio signal corresponds to the audio signal based on the known frequencies and the frequencies of the output audio signal.

The comparator 604 could determine whether frequencies of the output audio signal match the known frequencies, and determine that the output audio signal does not correspond to the audio signal where any one or more of the known frequencies does not have a matching frequency in the output audio signal.

Audio verification could be repeated for multiple audio signals and multiple video frames. For example, the frequency detector 602 could receive multiple output audio signals that are output with respective video frames, and determine frequencies of each of the multiple audio signals. The comparator 604 could then determine whether each output audio signal corresponds to one of multiple audio signals that were input into the video/audio production equipment to be synchronized with the respective video frames by the video/audio production equipment.

The controller 606 could provide a control signal to cause the video/audio production equipment to add delay to one of the audio signal and the video signal responsive to a determination by the comparator 604 that the output audio signal does not correspond to the audio signal.

An amount by which the output audio signal is out of synchronization with the known video frame could be determined by the controller 606. The controller 606 could determine the out-of-synchronization amount in various ways. For example, the controller 606 could itself calculate the out-of-synchronization amount. The out-of-synchronization amount could instead be calculated by the comparator 604 as part of its audio signal correspondence determination and provided to the controller 606. In any case, under an out-of-synchronization condition, the controller 606 could provide a control signal to cause the video/audio production equipment to add, to either the audio signal or the video signal, delay based on the amount by which the output audio signal is out of synchronization with the known video frame.

In a multiple-frequency embodiment, the respective different known frequencies could encode a message from a predetermined sequence of messages respectively associated with different audio signals to be synchronized to different video frames of the video signal by the video/audio production equipment. The comparator 604 could then determine whether the output audio signal corresponds to the audio signal by determining whether the frequencies of the output audio signal encode a message matching a message encoded by the known frequencies. The controller 606 determines an amount by which the output audio signal is out of synchronization with the known video frame based on relative positions, in the predetermined sequence of messages, of the message encoded by the frequencies of the output audio signal and the message encoded by the known frequencies. This amount may be determined by the controller 606, responsive to a determination by the comparator 604 that the frequencies of the output audio signal do not encode a message matching a message encoded by the known frequencies, by calculating this amount itself or otherwise relying on a calculation by a different component such as the comparator 604. In an embodiment, the controller 606 provides a control signal to cause the video/audio production equipment to add, to the audio signal or the video signal, delay based on the amount by which the output audio signal is out of synchronization with the known video frame.

The audio signal could include transitions at known positions between known signal components that have different respective frequencies. The controller 606 could then determine an amount by which the output audio signal is out of synchronization with the known video frame based on transition positions between the frequencies of the output audio signal and the known positions. Again, the controller 606 could calculate this amount itself or receive it from another component that performs the calculation, for example, and provide a control signal to cause the video/audio production equipment to add, to the audio signal or the video signal, delay based on the out-of-synchronization amount.

Audio signal verification by the example apparatus 600 involves comparison of one or more output frequencies or encoded values to one or more known frequencies or values encoded by the known frequency or frequencies. A set of frequencies, and an encoding scheme where encoded values are used, could be predefined and stored in the memory 608. The comparator 604 then has access to information that specifies the known frequencies, and encoding if used, for audio signal verification.

An apparatus could include additional components as well, such as one or more user interface devices to receive inputs from a user and/or to provide outputs to a user. For example, through a user interface device, a user could specify an audio signal that is to be synchronized with each video frame. This information could be stored in the memory 608 and subsequently accessed by the comparator to verify the audio signals. The memory 608 could even store audio test signals that are used in audio signal verification. A single computer system, for example, could be coupled to both an input and an output of video/audio production equipment, supply audio signals and possibly video signals to the video/audio production equipment, and perform audio signal verification. Such a computer system could track, in the memory 608 for example, the audio signals which are input into the equipment under test and accordingly the audio signals it should expect to receive at the equipment output.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the scope of an invention as defined in the appended claims.

What has been described is merely illustrative of the application of principles of embodiments of the present disclosure. Other arrangements and methods can be implemented by those skilled in the art.

For example, embodiments could include fewer, more, and/or different components than explicitly shown in FIG. 1 and/or FIG. 6, interconnected in a similar or different order. Methods could similarly include fewer, more, and/or different operations performed in a similar or different manner than explicitly shown in FIG. 2.

In addition, although described primarily in the context of methods and apparatus, other implementations are also contemplated, as instructions stored on a non-transitory computer-readable medium, for example.

The frequency of an output audio signal could be analyzed using any of various methods and using any of various types of equipment, including video/audio capture devices, computers, tablets, or any other electronic devices that have data processing capabilities. Such devices could contain a memory storing software that, when executed, is capable of performing audio signal verification as described herein.

What is claimed is:

1. A method comprising:

inputting a video signal into video/audio production equipment;

inputting an audio signal into the video/audio production equipment, the audio signal comprising a series of known signal components with respective different known frequencies, the different known frequencies encoding information that identifies a known video frame in the video signal to which the audio signal is to be synchronized by the video/audio production equipment;

determining, based on the different known frequencies and respective different frequencies of a series of signal components of an output audio signal that is output by the video/audio production equipment with the known video frame, whether information encoded by the different frequencies of the output audio signal components identifies the known video frame.

2. The method of claim 1, further comprising:

repeating the inputting and determining for a plurality of audio signals and multiple video frames.

3. The method of claim 1, further comprising:

adding delay to one of the audio signal and the video signal responsive to determining that the information encoded by the different frequencies of the output audio signal components does not identify the known video frame.

4. The method of claim 1, further comprising:

calculating an amount by which the output audio signal is out of synchronization with the known video frame where it is determined that the information encoded by the different frequencies of the output audio signal components does not identify the known video frame;

adding, to one of the audio signal and the video signal, delay based on the amount by which the output audio signal is out of synchronization with the known video frame.

5. The method of claim 1, the audio signal comprising transitions at known positions between the known signal components, the method further comprising:

determining transition positions between the signal components of the output audio signal;

calculating an amount by which the output audio signal is out of synchronization with the known video frame based on the transition positions of the output audio signal and the known positions;

adding, to one of the audio signal and the video signal, delay based on the amount by which the output audio signal is out of synchronization with the known video frame.

6. An apparatus comprising:

a frequency detector to receive an output audio signal that comprises a series of signal components with respective different frequencies and is output by video/audio production equipment with a video frame, and to determine the different frequencies the output audio signal components;

a comparator, coupled to the frequency detector, to determine based on the different frequencies of the output audio signal components and respective different known frequencies of signal components, whether information that is encoded by the different frequencies of the output audio signal components identifies a known video frame that is identified by information that is encoded by the respective different known frequencies of a series of known signal components of an audio signal that was input into video/audio production equipment to be synchronized with the known video frame by the video/audio production equipment.

7. The apparatus of claim 6, the frequency detector and the comparator being implemented using a computing device to execute software stored in a non-transitory computer-readable medium.

8. The apparatus of claim 6, the frequency detector being configured to receive a plurality of output audio signals that are output with respective video frames, and to determine frequencies of signal components of each of the multiple audio signals, the comparator being configured to determine whether information that is encoded by the frequencies of the signal components of each output audio signal identifies a respective known video frame that is identified by information that is encoded by different known frequencies of signal components of one of a plurality of audio signals that were input into the video/audio production equipment to be synchronized with the respective video frames by the video/audio production equipment.

9. The apparatus of claim 6, further comprising:

a controller, operatively coupled to the comparator, to provide a control signal to cause the video/audio production equipment to add delay to one of the audio signal and the video signal responsive to a determination by the comparator that the information that is encoded by the different frequencies of the output audio signal components does not identify the known video frame.

10. The apparatus of claim 6, further comprising:

a controller, operatively coupled to the comparator, to determine an amount by which the output audio signal is out of synchronization with the known video frame, and to provide a control signal to cause the video/audio production equipment to add, to one of the audio signal and the video signal, delay based on the amount by which the output audio signal is out of synchronization with the known video frame.

11. The apparatus of claim 6, the audio signal comprising transitions at known positions between the known signal components, the apparatus further comprising:

a controller, operatively coupled to the comparator, to determine an amount by which the output audio signal is out of synchronization with the known video frame based on transition positions between the frequencies of the output audio signal components and the known positions, and to provide a control signal to cause the video/audio production equipment to add, to one of the audio signal and the video signal, delay based on the amount by which the output audio signal is out of synchronization with the known video frame.

12. A method comprising:

assigning respective values to a plurality of frequencies;

inputting, into video/audio production equipment, an audio signal that comprises a series of signal components having multiple known frequencies of the plurality of frequencies encoding in the audio signal multiple known values of the respective values, the multiple known values comprising values that identify a video frame of a video signal;

determining frequencies of a series of signal components in an output audio signal that is output by the video/audio production equipment;

decoding values of the respective values encoded by the determined frequencies in the output audio signal;

determining, whether the values encoded by the determined frequencies in the output audio signal identify the video frame that is identified by the known values encoded in the audio signal.

13. The method of claim 12, wherein said respective values are hexadecimal values.

14. The method of claim 12, wherein said respective values are base-32 values.

15. The method of claim 1, wherein the information encoded by the different known frequencies of the audio signal components comprises a video frame number of the known video frame.

16. The method of claim 1, wherein the information encoded by the different known frequencies of the audio signal components further comprises information identifying a source of the audio signal.

17. The method of claim 4, wherein the information encoded by the different known frequencies of the audio signal components comprises a known video frame number of the known video frame, wherein the information encoded by the different frequencies of the output audio signal components comprises a video frame number, wherein the calculating comprises calculating the amount as a difference between the known video frame number and the video frame number.

* * * * *